US010138635B1

(12) United States Patent
Yeo

(10) Patent No.: US 10,138,635 B1
(45) Date of Patent: Nov. 27, 2018

(54) SYSTEM FOR DRY EXECUTION OF FINISHING MATERIAL

(71) Applicant: EUTOPLUS CO., LTD., Giheung-gu, Yongin-si (KR)

(72) Inventor: Yong Soo Yeo, Yongin-si (KR)

(73) Assignee: Eutoplus Co., Ltd., Yongin (KR)

( * ) Notice: Subject to any disclaimer, the term of this patent is extended or adjusted under 35 U.S.C. 154(b) by 0 days.

(21) Appl. No.: 15/956,899

(22) Filed: Apr. 19, 2018

(30) Foreign Application Priority Data

Dec. 22, 2017 (KR) ..... 10-2017-0177800

(51) Int. Cl.
*E04F 13/08* (2006.01)

(52) U.S. Cl.
CPC ..... *E04F 13/0819* (2013.01); *E04F 13/083* (2013.01); *E04F 13/0805* (2013.01)

(58) Field of Classification Search
CPC . E04F 13/0819; E04F 13/083; E04F 13/0805; E04F 13/0803; E04F 13/0894; E04F 13/076; E04F 13/18; E04F 13/12
See application file for complete search history.

(56) References Cited

U.S. PATENT DOCUMENTS 1,388,181 A * 8/1921 Guimonneau ..... E04B 2/28 52/571
1,936,507 A * 11/1933 Green ..... E04F 13/0801 52/287.1
4,270,327 A * 6/1981 Van Leeuwen ..... E04B 2/96 52/506.08
4,700,527 A * 10/1987 Pardo ..... E04B 2/12 52/772
4,773,201 A * 9/1988 Trezza ..... E04F 13/0801 52/387
4,890,433 A * 1/1990 Funaki ..... E04F 13/0801 52/385
5,423,155 A * 6/1995 Bauer ..... A47F 5/0846 40/618

(Continued)

FOREIGN PATENT DOCUMENTS

DE 102009011564 A1 * 9/2010 ..... E04F 13/081
DE 102011075011 A1 * 12/2011 ..... E04F 13/0803

(Continued)

*Primary Examiner* — Rodney Mintz
(74) *Attorney, Agent, or Firm* — John H. Choi & Associates LLC

(57) ABSTRACT

A system for dry execution of finishing material comprises a quadrangle bar to fix to an outer wall of a structure, a fixing bracket to install by fixing both ends thereof to the quadrangle bar, and a brick having an engaging groove formed in one surface facing the fixing bracket and being engaged with the fixing bracket in a fitting manner, wherein the fixing bracket comprises an engaging plate for allowing the brick to engage with the fixing bracket by locking engagement operation to the engaging groove, a load supporting plate provided between the engaging plates neighboring in up and down directions to withstand a load, an elastic plate providing an elastic force to push the brick outward after the brick is caught on the fixing bracket, and a connection plate which is respectively provided at upper and lower ends of the fixing bracket and connected to another fixing bracket.

6 Claims, 4 Drawing Sheets

(56) References Cited

U.S. PATENT DOCUMENTS 6,421,974 B1 * 7/2002 Whitehouse ..... E04F 13/0864 52/384
6,802,165 B1 * 10/2004 Passeno ..... E04F 13/0862 52/288.1
8,464,487 B2 * 6/2013 Kenda ..... E04F 13/12 52/474
8,966,844 B2 * 3/2015 Bouchard ..... E04F 13/0862 52/314
9,016,020 B1 * 4/2015 Yang ..... E04F 13/0803 52/511
9,145,689 B2 * 9/2015 Deumer ..... E04F 13/081
9,366,030 B2 * 6/2016 Spear ..... E04F 13/0894
9,803,372 B2 * 10/2017 Griffiths ..... E04F 13/083
2004/0065035 A1 * 4/2004 De Vlam ..... E04F 13/0862 52/384
2005/0284063 A1 * 12/2005 Losse ..... E04F 13/0862 52/384
2011/0047916 A1 * 3/2011 Muller ..... E04F 13/144 52/477
2011/0146182 A1 * 6/2011 Kenda ..... E04F 13/0812 52/474
2014/0161516 A1 * 6/2014 Deumer ..... E04F 13/081 403/345
2015/0204072 A1 * 7/2015 Spear ..... E04F 13/0894 52/241
2016/0102462 A1 * 4/2016 Griffiths ..... E04F 13/083 52/550
2016/0208497 A1 * 7/2016 Yang ..... B32B 3/06
2017/0051515 A1 * 2/2017 Aquilani ..... E04F 13/0835
2017/0107724 A1 * 4/2017 Li ..... E04F 13/0814

FOREIGN PATENT DOCUMENTS

DE 102014005708 A1 * 10/2015 ..... E04F 13/083
EP 0165809 A2 * 12/1985 ..... E04B 9/26
EP 1621698 A2 * 2/2006 ..... E04F 11/116
KR 101334320 B1 * 11/2013

* cited by examiner

SYSTEM FOR DRY EXECUTION OF FINISHING MATERIAL

CROSS-REFERENCE TO RELATED APPLICATION

This application claims priority to and the benefit of Korean Patent Application No. 10-2017-0177800 filed in the Korean Intellectual Property Office on Dec. 22, 2017, the entire contents of which are incorporated herein by reference.

FIELD

The present invention relates to a system for dry execution of finishing material, in particular for the system for dry execution of finishing material capable of installing the finishing material such as a brick, etc. without a secondary fixing operation.

BACKGROUND

In general, as finishing methods, there are wet methods and dry methods to attach and fix a finishing material such as earthenware, ceramic, stone or terracotta panel, and brick to inner and outer walls of a building structure during construction of interior and exterior building structures.

In the wet method, a cement mortar adhesive is used between inner and outer walls of a building structure and a finishing material, and the cement as adhesive is applied to the back of each finishing material then the finishing material is attached one by one to the wall along a joint. Therefore, the working time is long, the labor cost is high, and curing time of the cement is required.

In the dry method, a separate fixing member made from metal or the like is installed between inner and outer walls and a finishing material so as to attach the finishing material to the inner and outer walls of a building structure in a spaced manner. Accordingly, it is advantageous that the construction time is short and the working is convenient as well as the heat insulating configuration is easy. Therefore, in recent years, construction methods to fix exterior material such as a brick using the dry method are often carried out.

Although a finishing material such as a brick may be fitted in a separate fixing member made from metal or the like, a secondary fixing operation is required to fix the finishing material and the fixing member in a state in which the finishing material is fitted in the fixing member since shaking, etc. occurs in a state in which the finishing material is fitted in the fixing member.

Thus, since the secondary fixing operation is required for fixing the exterior material to the fixing member, there are problems that the labor cost and the material cost increase and the construction time becomes long.

In addition, when the secondary fixing operation is carried out by a person who is not a skilled person, such that it is not precisely carried out, there is a problem that the finish of a building structure is not clean.

Similar disclosures are shown in the prior art, for example, in Korean Patent No. KR 10-1334320 B1, published Nov. 27, 2013.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention has been made in view of the above problems and the present invention provides a system for dry execution of finishing material, in which a secondary fixing operation for fixing the finishing material to the fixing member is not necessary and the finishing material is installed only by the dry execution.

Further, the present invention provides a system for dry execution of finishing material which is able to maintain the constant execution quality even when the secondary fixing operation is performed by a person who is unskilled or untrained.

A system for dry execution of finishing material according to an exemplary embodiment of the present invention may include a quadrangle bar to fix to an outer wall of a structure, a fixing bracket to install by fixing both ends thereof to the quadrangle bar, and a brick having an engaging groove formed in one surface facing the fixing bracket and being engaged with the fixing bracket in a fitting manner. The fixing bracket may include an engaging plate for allowing the brick to engage with the fixing bracket by locking engagement operation to the engaging groove, a load supporting plate provided between the engaging plates neighboring in up and down directions to withstand a load, an elastic plate providing an elastic force to push the brick outward after the brick is caught on the fixing bracket, and a connection plate which is respectively provided at upper and lower ends of the fixing bracket and connected to another fixing bracket neighboring in up and down directions.

The engaging plate may comprise an insert piece inserted to the engaging groove, a first extending piece which is extended from one end of the insert piece and touches with a lower portion of the load supporting plate located at an upper end of the engaging plate, and a second extending piece which is extended from one end of the first extending piece and touches with an upper portion of the load supporting plate located at a lower end of the engaging plate and is fastened with a screw for engaging the fixing bracket to the quadrangle bar.

The load supporting plate may comprise a plurality of head portions formed in an arch shape and facing the brick, and a body portion provided between head portions neighboring each other and extending by a predetermined distance toward the quadrangle bar side.

The connection plate may comprise a cover plate provided in a lower portion of a fixing bracket and resting against an upper end of another fixing bracket neighboring downward, and a base plate provided in an upper portion of the fixing bracket and supporting a cover plate of another fixing bracket neighboring upward.

A joint forming member forming a longitudinal joint may be included between one side brick installed on the fixing bracket and the other side brick installed neighboring the one side brick.

The joint forming member may have the same shape as the brick on a side face thereof, and be formed of an elastic material so as to maintain watertightness between the bricks.

A head portion of the screw may be coated with a thermal break material to block a thermal bridge through the screw.

According to a system for dry execution of finishing material of the present invention, a brick can be easily engaged with a fixing bracket and the brick can be stably supported in a state in which the brick is fixed to the fixing bracket by having an elastic member providing an elastic force to push the brick outward while the brick is caught on the fixing bracket.

In addition, a brick can be easily fixedly installed on a fixing bracket by even an unskilled person since the brick is fixed to the bracket by simply pushing the brick from outside to inside.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In addition, some of the figures are provided further details including exemplary dimensions which are in units of inches.

In the drawings.

Figure 1:
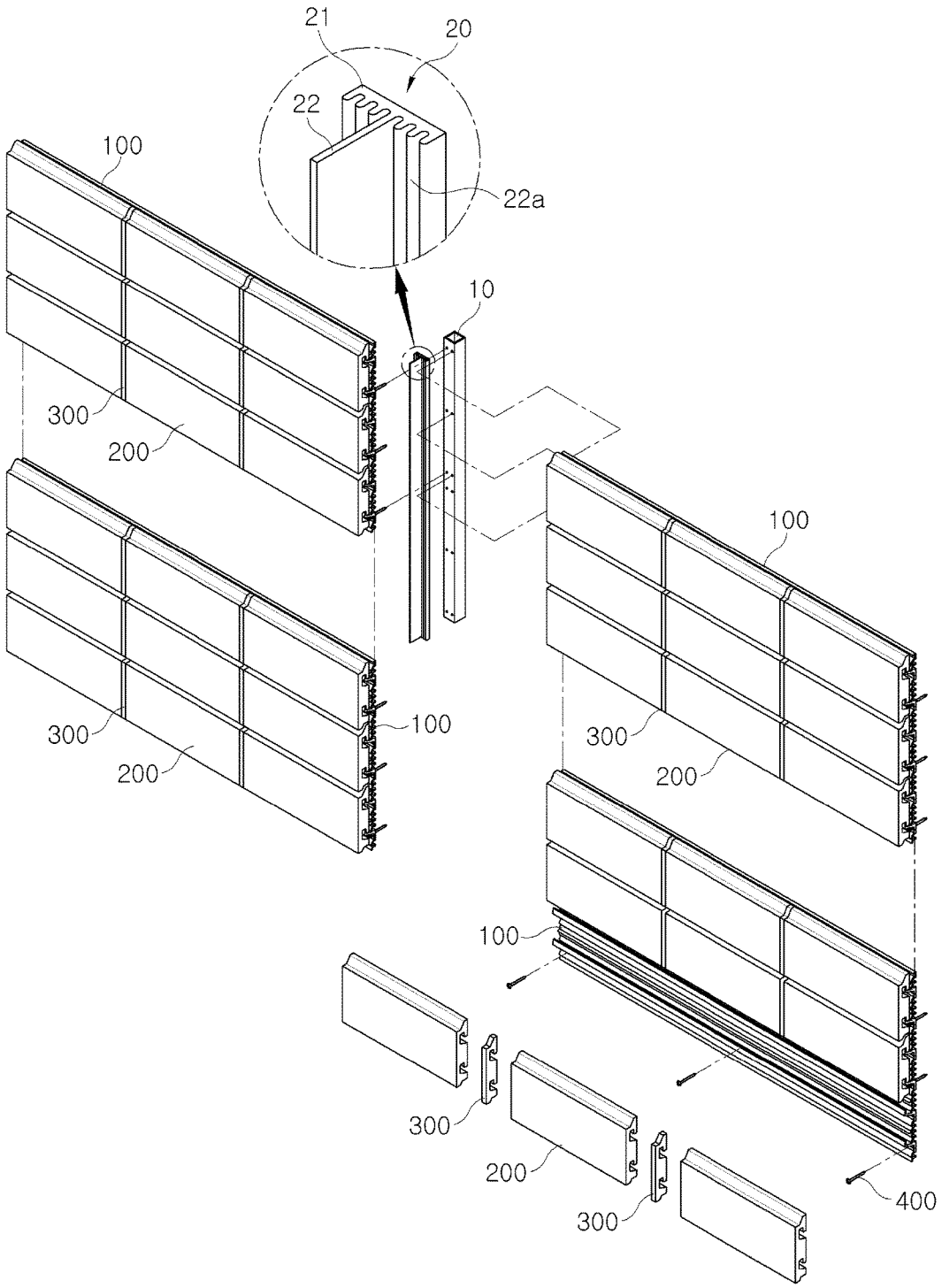
FIG. 1 is an exploded perspective view of a system for dry execution of finishing material according to one embodiment of the present invention.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left are used to describe the accompanying figures. The terminology includes the words above specifically mentioned, derivatives thereof, and words of similar import.

Hereinafter, a system for dry execution of finishing material according to one embodiment of the present invention will be described in detail with reference to the accompanying drawings.

Figure 2:
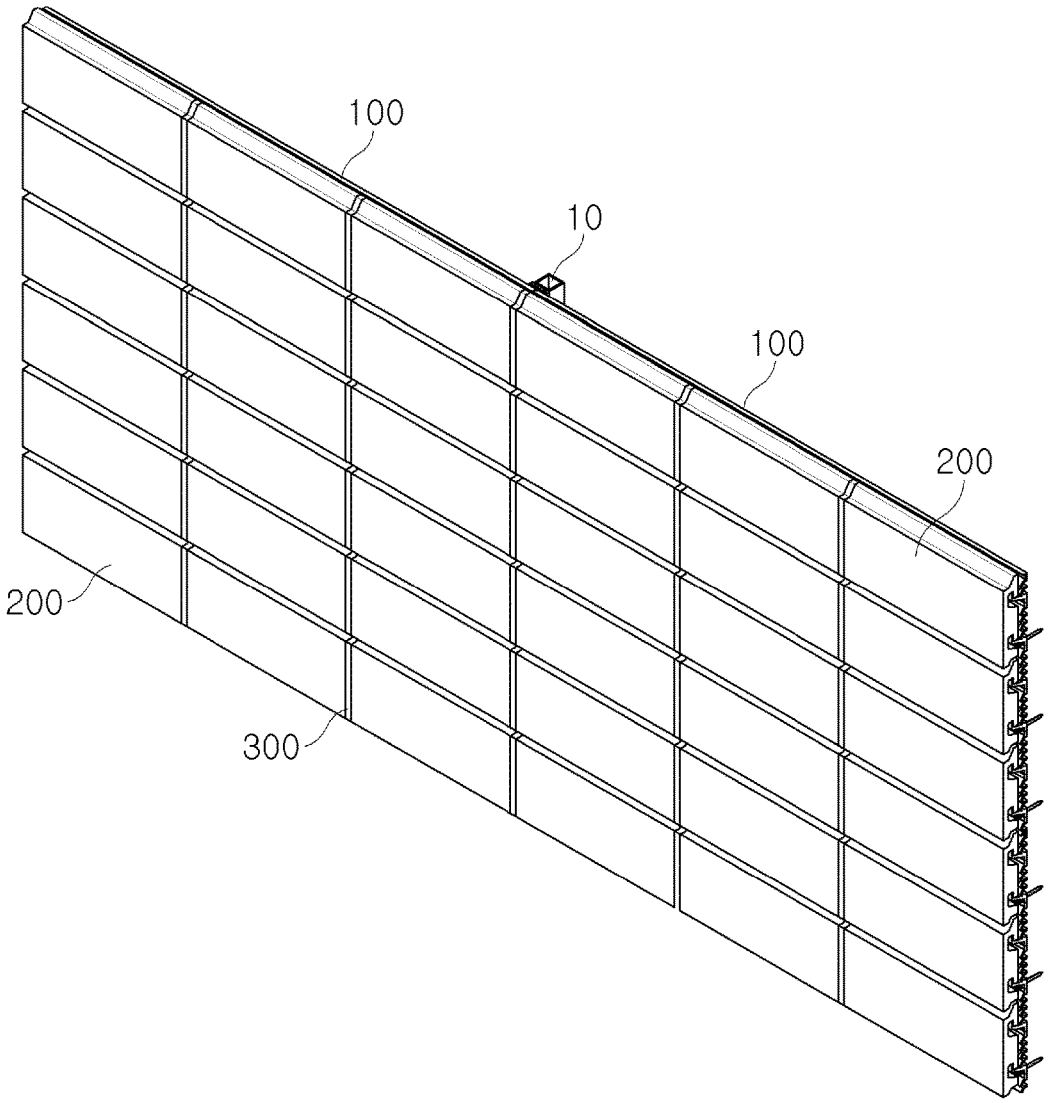
FIG. 2 is a perspective view of a system for dry execution of finishing material shown in FIG. 1.

FIG. 1 is an exploded perspective view of a system for dry execution of finishing material according to one embodiment of the present invention and FIG. 2 is a perspective view of a system for dry execution of finishing material shown in FIG. 1.

As shown in FIGS. 1 and 2, a system for dry execution of finishing material according to one embodiment of the present invention may include a quadrangle bar 10, a fixing bracket 100 to install by fixing both ends thereof to the quadrangle bar 10; and a brick 200 having an engaging groove 210 formed in one surface facing the fixing bracket 100 and engaged with the fixing bracket 100 in a fitting manner.

The quadrangle bar 10 is fixed to an outer wall of a structure, and may be formed of hollow rectangular pipe, or the like. The quadrangle bar 10 is made from a material such as aluminum, stainless steel, or the like such that it can firmly fix a fixing bracket 100.

When the fixing bracket 100 is fixed to the quadrangle bar 10, a waterproof member 20 may be included to engage with an end of a fixing bracket 100 of one side and with an end of a fixing bracket 100 of the other side, and to prevent moisture from penetrating between a fixing bracket 100 of one side and a fixing bracket 100 of the other side.

The waterproof member 20 may be formed of a material having elasticity so that the waterproof member 20 is in close contact with the fixing bracket 100 to prevent moisture from penetrating.

The waterproof member 20 may include a body 21 attached to the quadrangle bar 10 and a protrusion 22 inserted between an end of a fixing bracket 100 of one side and an end of a fixing bracket 100 of the other side. The body 21 is formed to be flat on one side thereof so as to attach to the quadrangle bar 10, and the other side of the body 21 is formed with a corrugated portion 21*a* so that it can be in close contact with an inside of the fixing bracket 100. The corrugated portion 21*a* is brought into close contact with an inside of the fixing bracket 100, whereby it is possible to prevent moisture from penetrating between a fixing bracket 100 of one side and a fixing bracket 100 of the other side.

The brick 200 may be formed by a terracotta method. A terracotta brick is a brick obtained by extruding clay into a predetermined shape and then firing or firing for baking at a high temperature of about from 1,000 to 1,450° C. Such bricks have excellent aesthetics and formability as well as abundant and homogenous material sources so that they are a typical inorganic finishing material that can replace natural stone finishing materials.

Although not shown in the drawings, the brick 200 may have a plurality of hollow portions formed therein to reduce weight.

Further, the brick 200 may have an engaging groove 210 formed in one surface thereof facing the fixing bracket 100 so that the brick 200 can be easily fixed to the fixing bracket 100 in a fitting manner.

The fixing bracket 100 is used to fix the brick 200 by dry method and may be manufactured by extruding or injecting a material such as PVC or aluminum or the like. When the fixing bracket 100 is formed of PVC, it can be formed by injection, and when the fixing bracket 100 is formed of aluminum, it can be formed by extrusion.

A system for dry execution of finishing material according to an embodiment of the present invention has a structure in which the brick 200 is easily fitted to the fixing bracket 100 by inserting the brick 200 into the fixing bracket 100 and is firmly supported in the state where the fixing bracket 100 is fastened to the quadrangle bar 10 through a fastening member such as a screw 400, thus it is possible to omit secondary fixing operation using cement mortar or adhesive. And, a non-skilled person can also easily combine the brick 200.

Next, the fixing bracket 100 will be described in more detail. In the following description, only the portions different from the above-described embodiment will be described in detail and detailed descriptions of the same or similar portions will be omitted.

Figure 3:
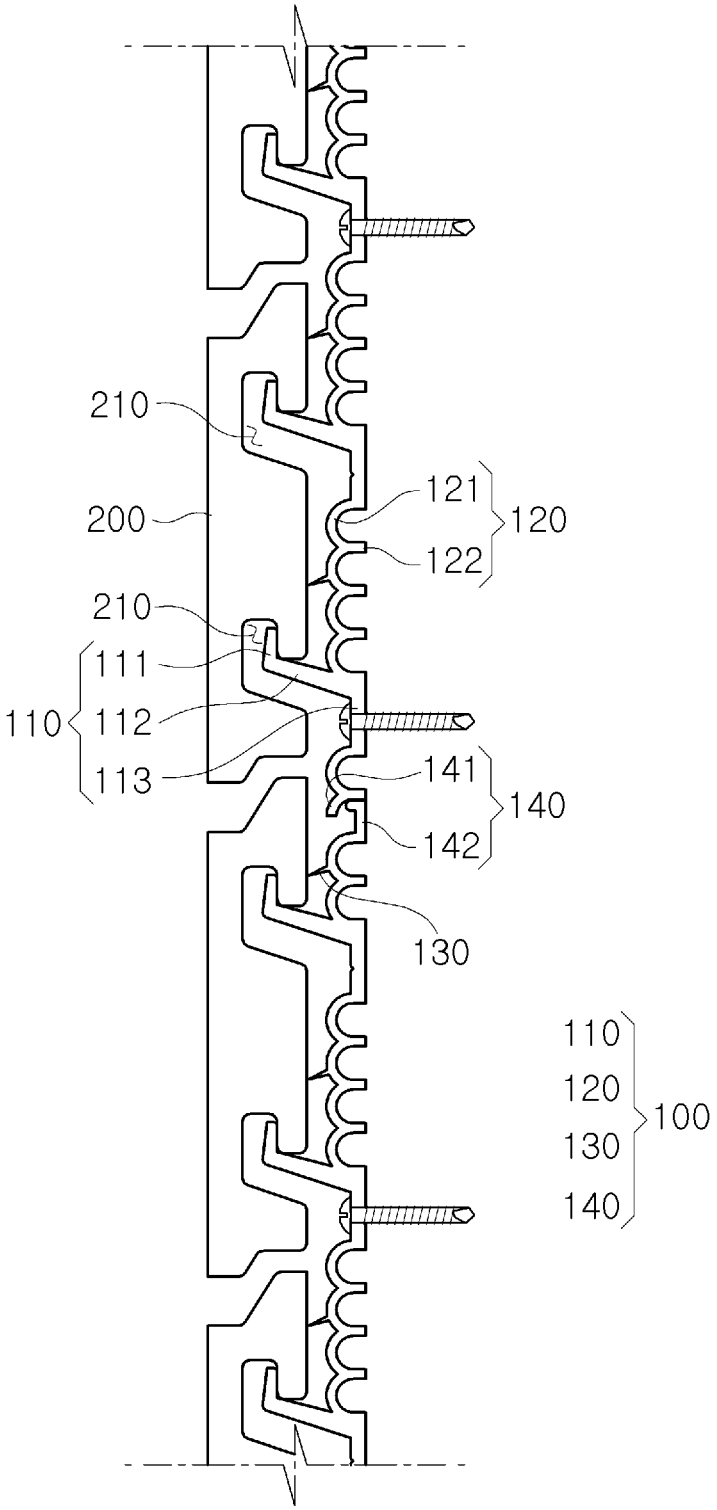
FIG. 3 is a sectional view of a brick engaged with a fixing bracket shown in FIG. 2.

FIG. 3 is a sectional view of a brick engaged with a fixing bracket shown in FIG. 2.

Referring to FIGS. 1 to 3, the fixing bracket 100 of a system for dry execution of finishing material according to an embodiment of the present invention engages with the engaging groove 210 of the brick 200 by locking engagement operation, such that the brick 200 and the fixing bracket 100 can be engaged.

For this reason, the fixing bracket 100 may include an engaging plate 110, a load supporting plate 120, an elastic plate 130, and a connection plate 140.

The engaging plate 110 may include an insert piece 111 inserted to the engaging groove 210 of the brick 200, a first extending piece 112 which is extended from a lower one end of the insert piece 111 by a predetermined distance in a direction of the quadrangle bar 10 and touches with a lower portion of the load supporting plate 120 located at an upper end of the engaging plate 110, and a second extending piece 113 which is extended downward from one end, which towards the quadrangle bar 10 side, of the first extending piece 112 and touches with an upper portion of the load supporting plate 120 located at a lower end of the engaging plate 110.

The insert piece 111 and the first extending piece 112 are provided in a shape similar to a hook so that, when the insert piece 111 is inserted into the engaging groove 210, an effect in which the brick 200 is hung on the fixing bracket 100 is exerted.

A screw 400 engaging the fixing bracket 100 to the quadrangle bar 10 may be fastened to the second extending piece 113. The screw 400 will be described more detail in below.

The load supporting plate 120 is provided between the engaging plates 110 neighboring upward and downward and can bear the load of the brick 200 engaged with the fixing bracket 100. For this reason, the load supporting plate 120 may include a head portion 121 formed in an arch shape and facing the brick 200, and a body portion 122 provided between head portions 121 neighboring each other and extending a predetermined distance toward the quadrangle bar 10 side. The fixing bracket 100 can stably bear high loads without increasing a thickness with the help of the load supporting plate 120 including a head portion 121 in the form of an arch shape, thereby improving an economic efficiency.

The elastic plate 130 is fixed to the load supporting plate 120 and protrudes toward the brick 200 side obliquely downward, and is formed such that its thickness becomes thinner toward the protruding one end, thereby it can have an elastic force.

Further, the elastic plate 130 may play a role as providing an elastic force to push the brick 200 outward after the brick 200 is caught on the fixing bracket 100. In this instance, a length of the elastic plate 130 in a horizontal direction is formed to be longer than a gap between the brick 200 and the fixing bracket 100 when the brick 200 is caught by the engaging plate 110 such that the brick 200 can be pushed using the elastic force of the elastic plate 130 when the brick 200 is caught by the engaging plate 110.

Accordingly, the brick 200 pushed by the elastic plate 130 can be more firmly fixed to the engaging plate 110, and can be fixed to the fixing bracket 100 without shaking.

The connection plate 140 may be respectively provided at the upper and lower ends of the fixing bracket 100 and connected to another fixing bracket 100 neighboring in up and down directions. For this reason, the connection plate 140 may include a cover plate 141 provided in a lower portion of a fixing bracket 100 and a base plate 142 provided in an upper portion of the fixing bracket 100. The cover plate 141 may be provided in a lower portion of a fixing bracket 100 and may be rested against an upper end of another fixing bracket 100 neighboring downward. The base plate 142 may be provided in an upper portion of the fixing bracket 100 and can play a role as supporting a cover plate 141 of another fixing bracket 100 neighboring upward. That is, it may be in the shape in which a fixing bracket 100 which is located in a relatively upper position is rested against a base plate 142 of a fixing bracket 100 which is located in a relatively lower position and at the same time the base plate 142 of the fixing bracket 100 which is located in a lower position supports the fixing bracket 100 which is located in a relatively upper position from below. In this instance, the cover plate 141 is provided so as to protrude further than the base plate 142 in the direction of the brick 200, such that it is possible to prevent external rainwater from penetrating between the cover plate 141 and the base plate 142.

Further, the connection plate 140 including a cover plate 141 of a fixing bracket 100 located in a relatively upward direction and a base plate 142 of a fixing bracket 100 located in a relatively downward direction is provided in the same size as the load supporting plate 120 to have continuity, so that the constructability can be improved.

Next, a joint forming member 300 installed on the fixing bracket 100 will be described in more detail. In the following description, only the portions different from the above-described embodiment will be described in detail and detailed descriptions of the same or similar portions will be omitted.

Figure 4:
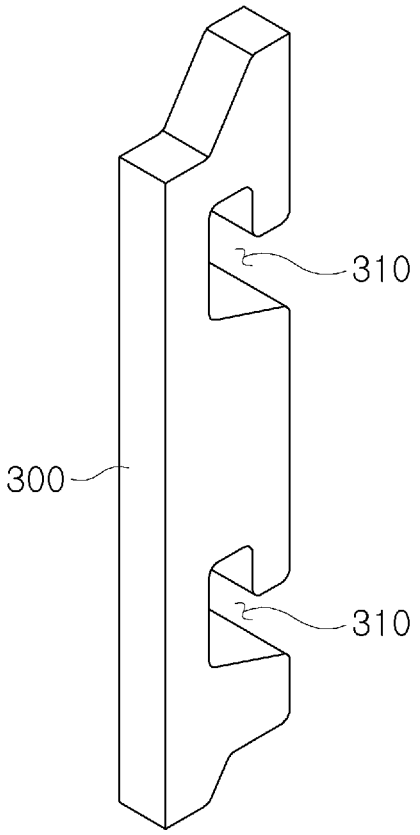
FIG. 4 is a perspective view of a joint forming member shown in FIG. 1.

FIG. 4 is a perspective view of a joint forming member shown in FIG. 1.

Referring to FIGS. 1 to 4, a system for dry execution of finishing material according to an embodiment of the present invention may include a joint forming member 300 forming a longitudinal joint between one side brick 200 installed on the fixing bracket 100 and the other side brick 200 installed neighboring the one side brick 200.

The joint forming member 300 may have the same shape as the brick on a side face thereof, and may be formed of an elastic material such as PVC or rubber or the like so as to maintain watertightness between the bricks 200.

Likewise, the joint forming member 300 forms a longitudinal joint by installing between one side brick 200 and the other side brick 200 neighboring in the horizontal direction, so that it makes an appearance of a building structure beautiful and also prevents cold air or moisture from penetrating between a brick 200 and a brick 200.

The joint forming member 300 may be fixed by being caught by the engaging plate 110 formed in a fixing bracket 100, in the same manner as the brick 200. For this reason, the joint forming member 300 may include a receiving groove 310 in the upper and lower ends thereof, respectively.

Next, a screw 400 fastened to the fixing bracket 100 of a system for dry execution of finishing material according to an embodiment of the present invention will be described in more detail. In the following description, only the portions different from the above-described embodiment will be described in detail and detailed descriptions of the same or similar portions will be omitted.

Figure 5:
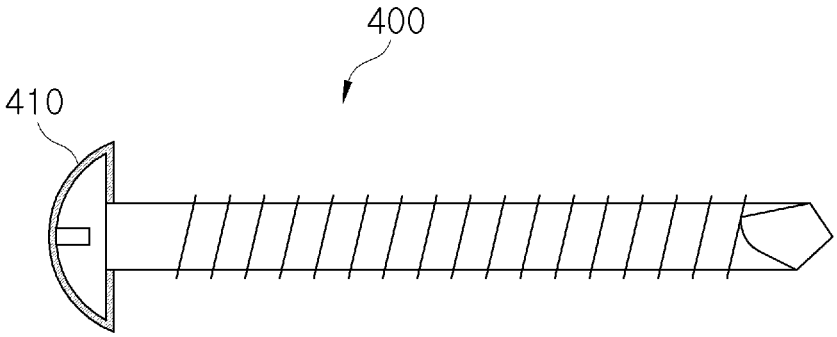
FIG. 5 is a view of a screw shown in FIG. 1.

FIG. 5 is a view of a screw shown in FIG. 1.

Referring to FIGS. 1 to 5, a fixing bracket 100 of a system for dry execution of finishing material according to an embodiment of the present invention can engage with a quadrangle bar 10 through a screw 400.

The screw 400 may be provided in which a head portion thereof is coated with a thermal break material 410 to block a thermal bridge through the screw 400. As the thermal break material 410, PVC or PVC coated aluminum may be used.

In this way, by providing a thermal break material 410, the heat of an outdoor side can be prevented from moving toward an indoor side through the screw 400.

As described above, a system for dry execution of finishing material according to an embodiment of the present invention includes an elastic plate 130 that provides an elastic force to push the brick 200 outward while the brick 200 is caught on the fixing bracket 100, such that the brick 200 can be easily engaged with a fixing bracket 100 and the brick 200 can be stably supported in a state in which the brick 200 is fixed to the fixing bracket 100.

Although a system for dry execution of finishing material according to embodiments of the invention have been described above, the spirit of the invention is not limited to the embodiments shown in this specification. Also, those skilled in the art, who understand the spirit of the invention, can readily suggest other embodiments by adding, changing, deleting, adding, or the like of components, and the other embodiments are within the scope of the invention.

The present invention may be embodied in other specific forms without departing from its spirit or essential characteristics. The described embodiments are to be considered in all respects only as illustrative and not restrictive. The scope of the invention, therefore, will be indicated by claims rather than by the foregoing description. All changes, which come within the meaning and range of equivalency of the claims, are to be embraced within their scope.

DESCRIPTION OF SYMBOLS

10: a quadrangle bar
20: a waterproof member
21: a body
22: a protrusion
22*a*: a corrugated portion
100: a fixing bracket
110: an engaging plate
111: an insert piece
112: a first extending piece
113: a second extending piece
120: a load supporting plate
121: a head portion
122: a body portion
130: an elastic plate
140: a connection plate
141: a cover plate
142: a base plate
200: a brick
210: an engaging groove
300: a joint forming member
310: a receiving groove
400: a screw
410: a thermal break material

What is claimed is:

1. A system for dry execution of finishing material, comprising:

a quadrangle bar to fix to an outer wall of a structure;

a fixing bracket to install by fixing both ends thereof to the quadrangle bar; and a brick having an engaging groove formed in one surface facing the fixing bracket and being engaged with the fixing bracket in a fitting manner;

wherein, the fixing bracket comprises:

an engaging plate allowing the brick to engage with the fixing bracket by locking engagement operation to the engaging groove;

a load supporting plate provided between the engaging plates neighboring in up and down directions to withstand a load, the load supporting plate having (i) a plurality of head portions formed in an arch shape and facing the brick and (ii) a body portion provided between the head portions neighboring each other and extending by a predetermined distance toward the quadrangle bar;

an elastic plate providing an elastic force to push the brick outward after the brick is caught on the fixing bracket; and a connection plate which is respectively provided at upper and lower ends of the fixing bracket and connected to another fixing bracket neighboring in said up and down directions.

2. The system according to claim 1, wherein the connection plate further comprises:

a cover plate provided in a lower portion of the fixing bracket and resting against an upper end of another fixing bracket neighboring downward; and a base plate provided in an upper portion of the fixing bracket and supporting a cover plate of another fixing bracket neighboring upward.

3. The system according to claim 1, further comprising a joint forming member forming a longitudinal joint between one side brick installed on the fixing bracket and the other side brick installed neighboring the one side brick.

4. The system according to claim 3, wherein the joint forming member has the same shape as the brick on a side face thereof, and is formed of an elastic material so as to maintain watertightness between the bricks.

5. The system for dry execution of finishing material according to claim 1, wherein the engaging plate further comprises:

an insert piece inserted to the engaging groove;

a first extending piece which is extended from one end of the insert piece and touches with a lower portion of the load supporting plate located at an upper end of the engaging plate; and a second extending piece which is extended from one end of the first extending piece and touches with an upper portion of the load supporting plate located at a lower end of the engaging plate, and is fastened with a screw for engaging the fixing bracket to the quadrangle bar.

6. The system according to claim 5, wherein a head portion of the screw is coated with a thermal break material to block a thermal bridge through the screw.

* * * * *